US006647885B2

(12) United States Patent
Murata et al.

(10) Patent No.: US 6,647,885 B2
(45) Date of Patent: Nov. 18, 2003

(54) MARKING SYSTEM, MARKING METHOD AND MARKING APPARATUS

(75) Inventors: Chikara Murata, Shizuoka (JP); Tomohisa Yamamoto, Shizuoka (JP); Masami Hirabayashi, Inazawa (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 10/106,374

(22) Filed: Mar. 27, 2002

(65) Prior Publication Data

US 2002/0139273 A1 Oct. 3, 2002

(30) Foreign Application Priority Data

Mar. 29, 2001 (JP) ..... 2001-095139

(51) Int. Cl.[7] ..... B41L 3/02
(52) U.S. Cl. ..... 101/486; 101/248
(58) Field of Search ..... 101/483, 484, 101/485, 486, 248; 382/112

(56) References Cited

U.S. PATENT DOCUMENTS 4,250,806 A * 2/1981 Boyson et al. ..... 101/2
4,587,411 A * 5/1986 Obstfelder ..... 101/483
4,885,785 A * 12/1989 Reynolds et al. ..... 382/112
4,948,982 A * 8/1990 Roulin ..... 101/181
5,043,904 A * 8/1991 Sikes et al. ..... 101/248
5,241,483 A * 8/1993 Porret et al. ..... 101/484
5,252,838 A * 10/1993 Timblin ..... 101/181
5,698,034 A * 12/1997 Clark et al. ..... 101/118
5,813,333 A * 9/1998 Ohno ..... 101/486
6,199,480 B1 * 3/2001 Leonhardt et al. ..... 101/248

* cited by examiner

*Primary Examiner*—Eugene H. Eickholt
(74) *Attorney, Agent, or Firm*—Nixon & Vanderhye P.C.

(57) ABSTRACT

There is provided a marking apparatus, a marking method, and a marking system that enable the position of a marking target to be accurately shown, and that reliably enable only that portion containing the marking target to be removed. The marking system has a detector that detects a marking target on a subject material and acquires the position thereof, a marking apparatus having heads capable of marking an optional position in the transverse direction of the subject material, and a control apparatus that sends a marking instruction to the marking apparatus when the position of the marking target in the transverse direction arrives at the marking apparatus, and the position of the marking target matches the position of a head of the marking apparatus.

4 Claims, 8 Drawing Sheets

MARKING SYSTEM, MARKING METHOD AND MARKING APPARATUS

BACKGROUND OF THE INVENTION

1. Field of the Invention

The present invention relates to a marking system and a marking method for performing the marking of marking targets such as defects on a subject material, and to a marking apparatus used in this marking system and marking method, and particularly to a marking system, a marking method, and a marking apparatus that enable marking to be performed either directly on or in the vicinity of a marking target.

2. Description of the Related Art

Conventionally, a marking system is known in which defects such as coating unevenness, scratches, and blemishes on the surface of a subject material such as plastic film, paper, and metal plate are detected, and marks showing the positions of the defects are made at the edges of the subject material. An example of this marking system is shown in FIG. 8. The marking system in FIG. 8 is formed by a detector 6, a labeling apparatus 32, and a control apparatus 33. The detector 6 is provided with a light source (not shown) that irradiates light onto a belt shaped subject material 2 that moves in a fixed direction, a camera 3 that captures transmission light or reflection light from the subject material 2 as image signals, and an image processing apparatus 5 that performs image processing on image signals by detecting a defect 4 on the subject material 2 and acquiring the position of the defect 4 on the subject material 2. The labeling apparatus 32 is installed downstream from the detector 6 and affixes a label 31 on an edge of the subject material 2. The control apparatus 33 sends an instruction to affix a label to the labeling apparatus 32 when the defect 4 arrives at the label affixing position of the labeling apparatus 32.

The detection of defects in this marking system is performed in the following manner.

Image signals of the surface of the subject material 2 captured by the camera 3 undergo image processing by the image processing apparatus 5. As a result of the image processing, if a detect 4 is detected on the subject material 2, the position X of the defect 4 in the transverse direction and the position Y of the defect 4 in the movement direction (corresponding to the distance from the front of the subject material) on the subject material 2 are acquired. Here, the position Y in the movement direction of the defect 4 represents a value (referred to below as a count value) obtained by counting, from the front of the subject material, standard pulses emitted from carrier lines (not shown) of the subject material 2 each time the subject material 2 moves a fixed distance. When necessary, the position of the defect 4 may be map displayed on a monitor (not shown), or may be recorded in a recording device (not shown), or it may be printed on paper.

When the position Y of the defect 4 in the movement direction reaches the label affixing position of the labeling apparatus 32, an instruction to affix a label is sent from the control apparatus 33 to the labeling apparatus 32. Here, it is determined that the position Y of the defect 4 in the movement direction has arrived at the label affixing position of the labeling apparatus 32 when the count value of the standard pulses matches a value equal to the sum of the count value representing the position Y of the defect 4 in the movement direction and a count correction value that corresponds to the distance between the camera 3 and the label affixing position, namely, when the count value after the position Y of the defect 4 in the movement direction is detected (i.e., the distance moved from the camera 3) matches the count correction value (i.e., the distance between the camera 3 and the label affixing position).

When the labeling apparatus 32 receives an instruction to affix a label, it affixes a label 31 showing only the position in the movement direction of the defect 4 to the edge of the subject material 2.

When the subject material 2 being examined for defects is a roll of a sheet shaped material such as an antireflection film for a liquid crystal display, CRT, or plasma display or the like, then, as is shown in FIG. 9, the antireflection processing is implemented by coating processing and sheets 34 that match the size of the display are cut out from the belt shaped subject material 2 being examined for defects.

However, when a label is simply affixed to the edge of the subject material 2, the problem arises that it is not possible to ascertain which of the plurality of cut out sheets 34 contains the defect 4.

As a result, in order to remove the sheet 34 containing the defect 4, it has hitherto been necessary to cut out and remove the entire width of the roll at the portion where the label is affixed with the sheets still in the roll state before they are die cut. If the removal is performed after the roll has been die cut, it is necessary either to remove a plurality of sheets 34 adjacent to where the label 31 is attached at the instant they are die cut from the subject material 2 in the form of a roll, or to visually reexamine all of the plurality of sheets 34 die cut from the subject material 2 in the form of a roll. Thus, because either the sheets 34 are cut out and removed in the form of a roll, or else a large number of good sheets are removed together with the defect sheet containing the defect 4 when a plurality of sheets 34 adjacent to where the label 31 is affixed are removed, the problem arises that the yield is reduced and the production efficiency of the die cutting operation is reduced. Moreover, if all of the die cut sheets 34 are visually reexamined, the problem arises that time and labor costs increase. In addition, if a defect is not visually obvious, the concern exists that it may be overlooked in a visual inspection.

It is therefore an aim of the present invention to provide a marking system, a marking method, and a marking apparatus used in this system and method that enable the position of a marking target to be accurately shown, and that reliably enable only that portion containing the marking target to be removed.

SUMMARY OF THE INVENTION

The marking system of the present invention comprises: a detector that detects a marking target on a belt shaped subject material moving in a fixed direction at a fixed speed and acquires the position of the marking target on the subject material; a marking apparatus having a head that is located downstream from the detector and that is capable of marking an optional position in a transverse direction of the subject material; and a control apparatus that transmits the position of the marking target in the transverse direction that was acquired by the detector to the marking apparatus, and sends a marking instruction to the marking apparatus when the position of the marking target matches the position of the head of the marking apparatus.

In the marking system of the present invention, it is possible to make a mark either directly on or adjacent to a marking target. Because it is possible according to this marking system to accurately show the position of a marking target, after the subject matter is examined, the reliable removal of only that portion where the marking target is located can be performed.

Moreover, in the marking system of the present invention, if the marking apparatus has a plurality of heads and the control apparatus is able to allocate a head for each marking target, then it is possible for marking failures to be kept to the absolute minimum even when a plurality of marking targets are detected in a short period of time.

The marking method of the present invention is a method in which a mark is made on a marking target on a subject material by a marking apparatus having a head that is capable of marking an optional position in a transverse direction of the subject material. This method comprises: a step in which a marking target on a belt shaped subject material moving in a fixed direction at a fixed speed is detected at a position upstream from the marking apparatus, and the position of the marking target on the subject material is acquired; a step in which the acquired position in the transverse direction of the marking target is transmitted to the marking apparatus; and a step in which a marking instruction is sent to the marking apparatus when the position of the marking target matches the position of the head of the marking apparatus.

In the marking method of the present invention, a mark can be made either directly on or adjacent to a marking target. Because it is possible according to this marking system to accurately show the position of a marking target, after the subject matter is examined, the reliable removal of only that portion where the marking target is located can be performed.

Moreover, in the marking method of the present invention, if the marking apparatus has a plurality of heads and there is included a step in which a head is allocated for each marking target, then it is possible for marking failures to be kept to the absolute minimum even when a plurality of marking targets are detected in a short period of time.

The marking apparatus of the present invention comprises a head for discharging ink and a box for housing the head. The head is capable of movement inside the box, and an outlet for ink discharged from the head and an air outlet are provided in the box.

In the marking apparatus of the present invention, it is possible to prevent dust generated by the movement of a head from falling onto the subject material.

In addition, if the marking apparatus of the present invention has a plurality of heads, it is possible for marking failures to be kept to the absolute minimum even when a plurality of marking targets are detected in a short period of time.

Moreover, by connecting an ink cartridge to the head, no hose is needed to connect the head to the inkjet printer body, enabling the space required to be reduced and the movement of the head to be speeded up. In addition, problems connected with blockages of the hose can be avoided.

DESCRIPTION OF THE PREFERRED EMBODIMENTS

The present invention will now be described in detail.

Figure 1:
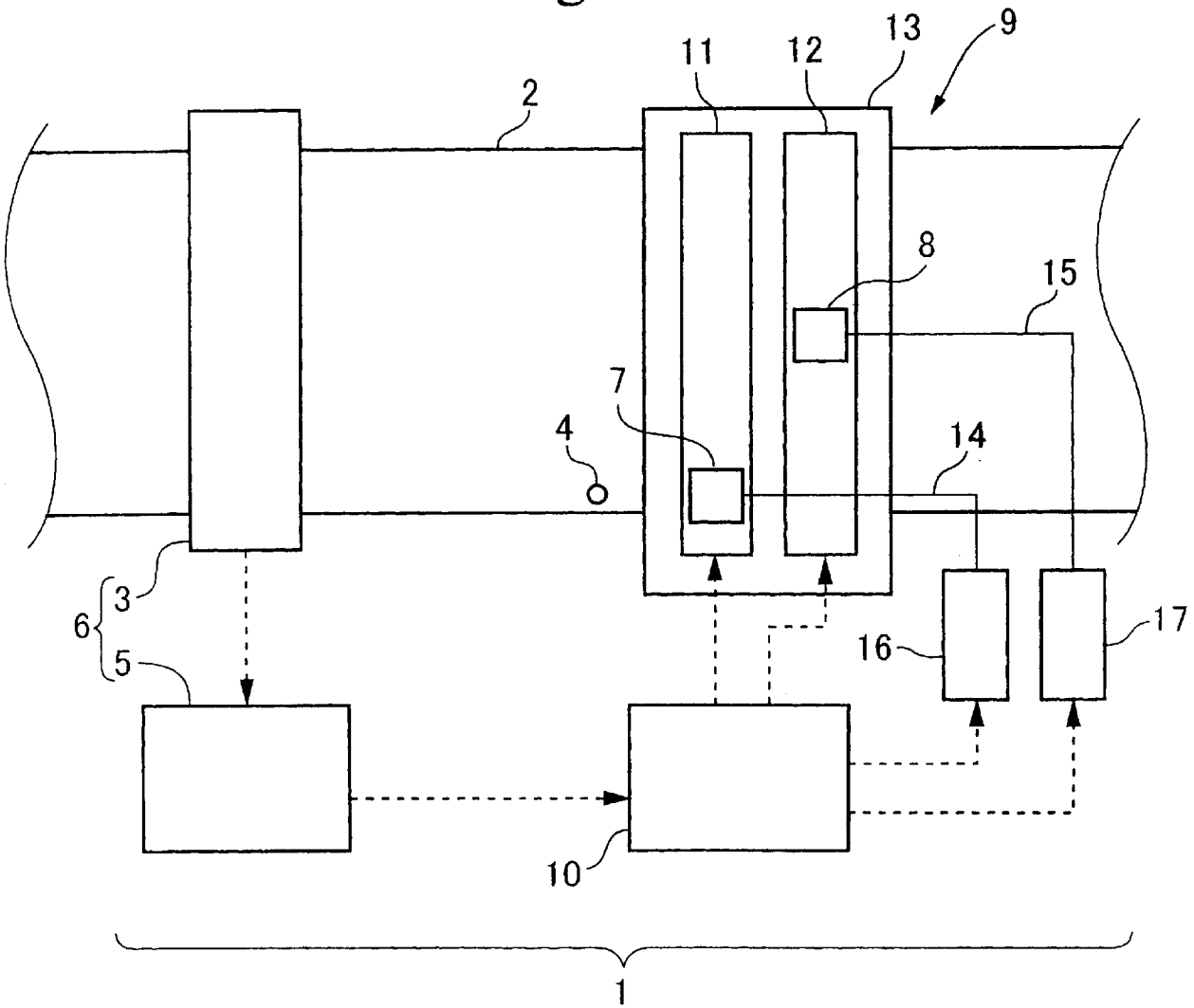
FIG. 1 is a schematic structural diagram showing an example of the marking system of the present invention.

FIG. 1 is a schematic structural diagram showing an example of the present invention. Schematically, the marking system1 is formed by a detector 6, a marking apparatus 9, and a control apparatus 10. The detector 6 is provided with a light source (not shown) that irradiates light onto a belt shaped subject material 2 that moves in a fixed direction, a camera 3 that captures transmission light or reflection light from the subject material 2 as image signals, and an image processing apparatus 5 that performs image processing on image signals by detecting a defect 4 on the subject material 2 and acquiring the position X in the transverse direction and the position Y in the movement direction (corresponding to the distance from the front of the subject material 2) of the defect 4 on the subject material 2. The marking apparatus 9 is installed downstream from the detector 6 and has heads 7 and 8 capable of marking optional positions in the transverse direction of the subject material 2. The control apparatus 10 sends a marking instruction to the marking apparatus 9 when the position X of the defect 4 in the transverse direction acquired by the image processing apparatus 5 of the detector 6 arrives at the marking apparatus 9, and when the position of the defect 4 matches the position of the head 7 or the head 8 of the marking apparatus 9.

The position Y in the movement direction of the defect 4 represents a value (referred to below as a count value) obtained by counting, from the front of the subject material, standard pulses emitted from carrier lines (not shown) of the subject material 2 each time the subject material 2 moves a fixed distance.

It is determined that the position of the defect 4 matches the position of the head 7 or the head 8 of the marking apparatus 9 when the position X of the defect portion 4 in the transverse direction matches the position X2 of the head 7 or the head 8 in the transverse direction, and, at the same time, the count value of the standard pulses reaches a value equal to the sum of the count value representing the position Y of the defect 4 in the movement direction and a count correction value that corresponds to the distance between the camera 3 and the head 7 or the head 8, namely, the count value after the position Y of the defect 4 in the movement direction is detected (i.e., the distance moved from the camera 3) matches the count correction value (i.e., the distance between the camera 3 and the head 7 or the head 8).

The subject material 2 may be a belt shaped plastic film, paper, a metal plate, cloth, or the like.

The light source is one that irradiates light in a direction that is orthogonal to the direction of movement of the subject material 2. Fluorescent lights, high frequency fluorescent lights, and quartz rod lighting, for example, can be used as the light source.

The camera 3 is positioned such that the longitudinal direction thereof is orthogonal to the movement direction of the subject material 2. The camera 3 captures transmission light (or reflection light) from the subject material 2 and outputs an image signal of the surface of the subject material 2. A CCD (charge coupled device) camera provided with linearly arranged image sensing elements, for example, may be used as the camera 3.

The image processing apparatus 5 performs image processing on image signals output from the camera 3, detects defects 4 on the subject material 2, acquires the position (X, Y) of a defect 4 on the subject material 2, and outputs this to the control apparatus 10. A known image processing apparatus normally used in the field of defect examination can be used for the image processing apparatus 5.

Figure 2:
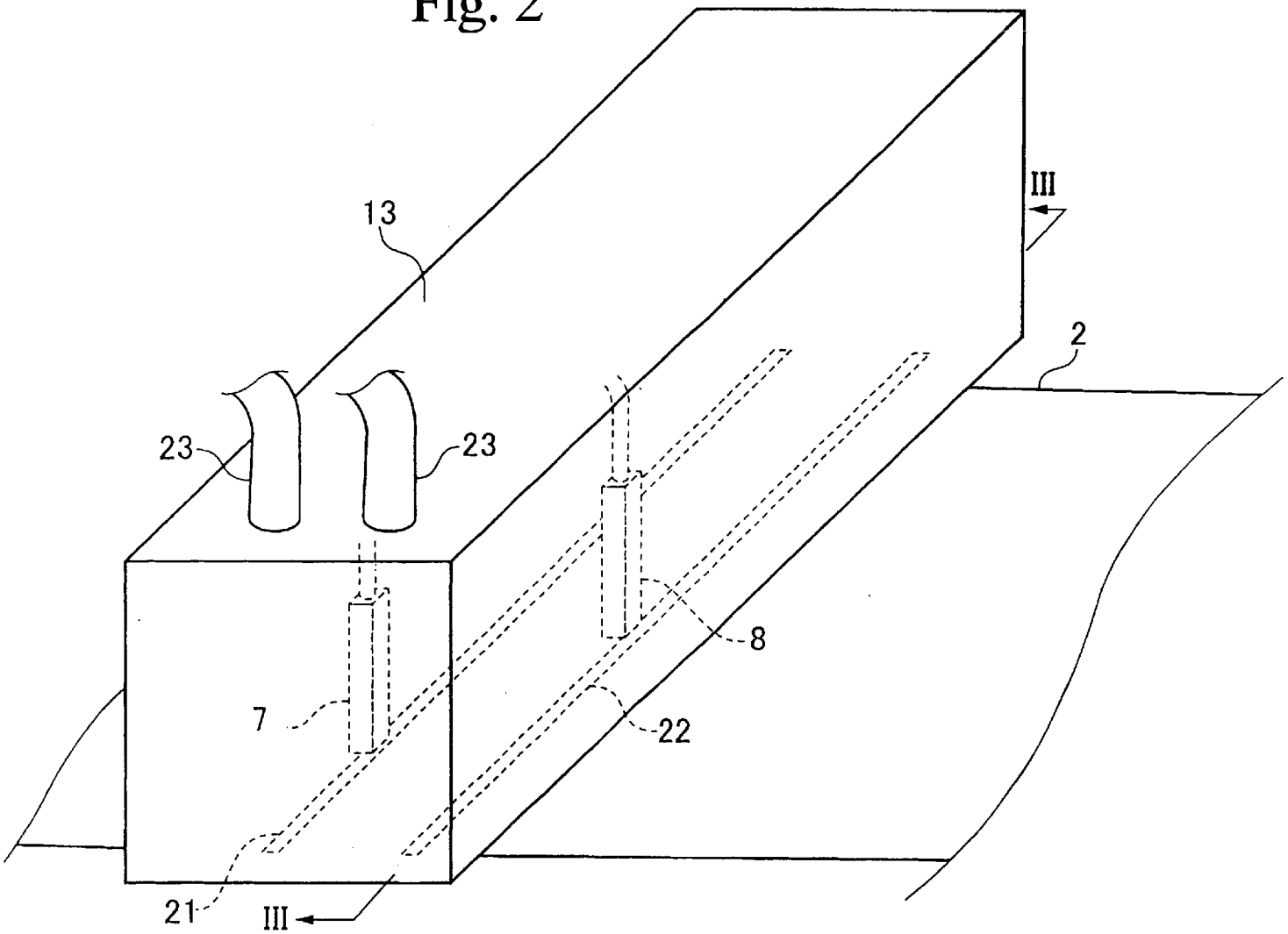
FIG. 2 is a perspective view showing an example of the marking apparatus of the present invention.
Figure 3:
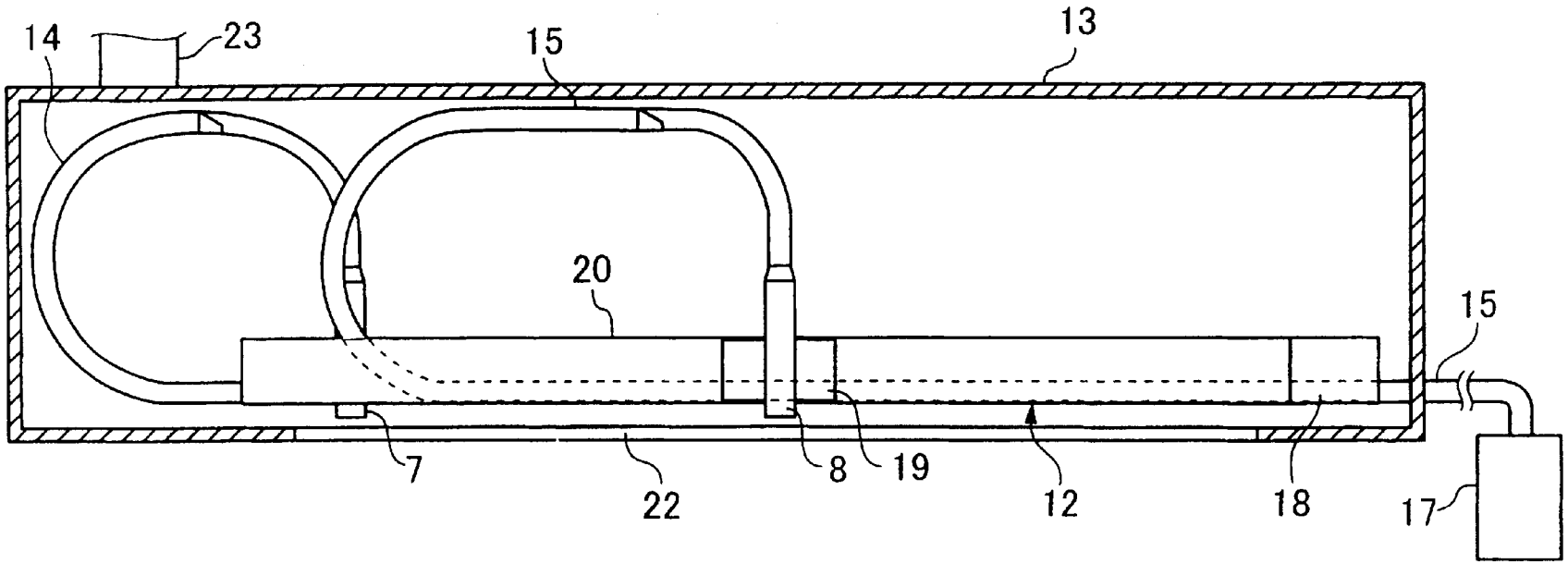
FIG. 3 is a cross sectional view taken along the line III—III in FIG. 2.

As is shown in FIGS. 1, 2, and 3, schematically, the marking apparatus 9 is formed by heads 7 and 8, head travel sections 11 and 12, a box 13, and inkjet printer bodies 16 and 17. The heads 7 and 8 are arranged such that discharge apertures thereof (not shown) face the subject material 2. The head travel sections 11 and 12 move the heads 7 and 8 in a transverse direction on the subject material 2 based on the position X1 of the defect 4 in the transverse direction transmitted from the control apparatus 10. The box 13 houses the heads 7 and 8 and the head travel sections 11 and 12. The inkjet printer bodies 16 and 17 supply ink to the heads 7 and 8 via pipes 14 and 15 and cause ink to be discharged from the heads 7 and 8 based on marking instructions sent from the marking apparatus 9.

Normal inkjet printer heads can be used for the heads 7 and 8. Examples of such heads include piezo-electric element types and bubble jet types.

In the head travel section 11 (12), a head fixing portion 19, on which the head 7 (8) is fixed, is moved along a rail 20 in the transverse direction of the subject material 2 by a servo motor 18.

On the bottom surface of the box 13 are provided ink outlets 21 and 22 that are shaped as slits running in the direction in which the heads move. The ink outlets 21 and 22 are outlets for ink that is discharged from the discharge apertures of the heads 7 and 8. On the top surface of the box 13 are provided air outlets 23 for expelling air from inside the box 13. By expelling the air inside the box 13 from the top surface of the box 13 and taking in external air from the ink outlets 21 and 22, dust generated by the movement of the heads 7 and 8 can be prevented from falling onto the subject material 2.

The pipes 14 and 15 that are attached to the box 13 from one end in the longitudinal direction of the box 13 extend respectively along the head travel sections 11 and 12. The pipes 14 and 15 are made longer than the box 13 in the longitudinal direction thereof and this surplus length is bent back in a large U shape at the other end in the longitudinal direction of the box 13. The distal ends of the pipes are bent in a vertical direction and are connected respectively to the top ends of the heads 7 and 8. It is preferable from the standpoint of preventing ink from clogging and the like that the bend in the U shape bent portion is made as large as possible.

There are no particular restrictions as to the pipes 14 and 15, however, it is preferable that the material used has sufficient durability and flexibility to withstand the bending and stretching that accompany the movement of the heads 7 and 8.

The inkjet printer bodies 16 and 17 have an ink tank (not shown) for supplying ink to the heads 7 and 8 respectively via the pipes 14 and 15, and a head control section (not shown) that is electrically connected to the heads 7 and 8 by a flexible cable.

The control apparatus 10 can be broadly divided into a computer section and a control board (neither is shown). The computer section allocates a head 7 or 8 to each of a plurality of defects 4, issues movement instructions to the heads 7 and 8 based on the position X of a defect 4 in the transverse direction that has been acquired in the image processing apparatus 5, performs marking processing such as issuing marking instructions to the marking apparatus, and the like. The control board performs the control of the marking apparatus 9 based on the standard pulse count and instructions from the computer section.

More specifically, the computer section of the control apparatus 10 performs the following processing.

Figure 4:
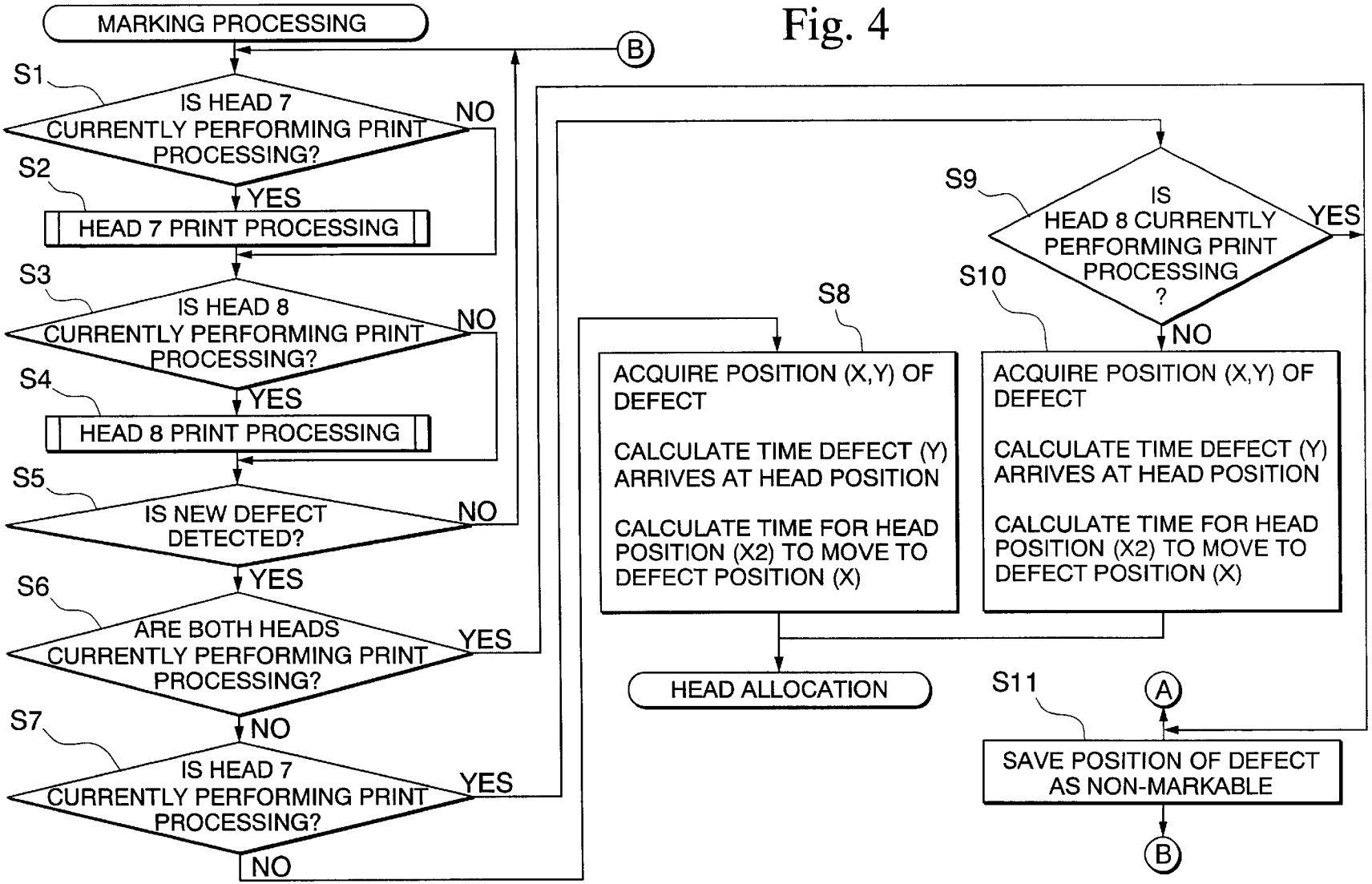
FIG. 4 is a flow chart showing an example of the marking processing in the marking system of the present invention.
Figure 5:
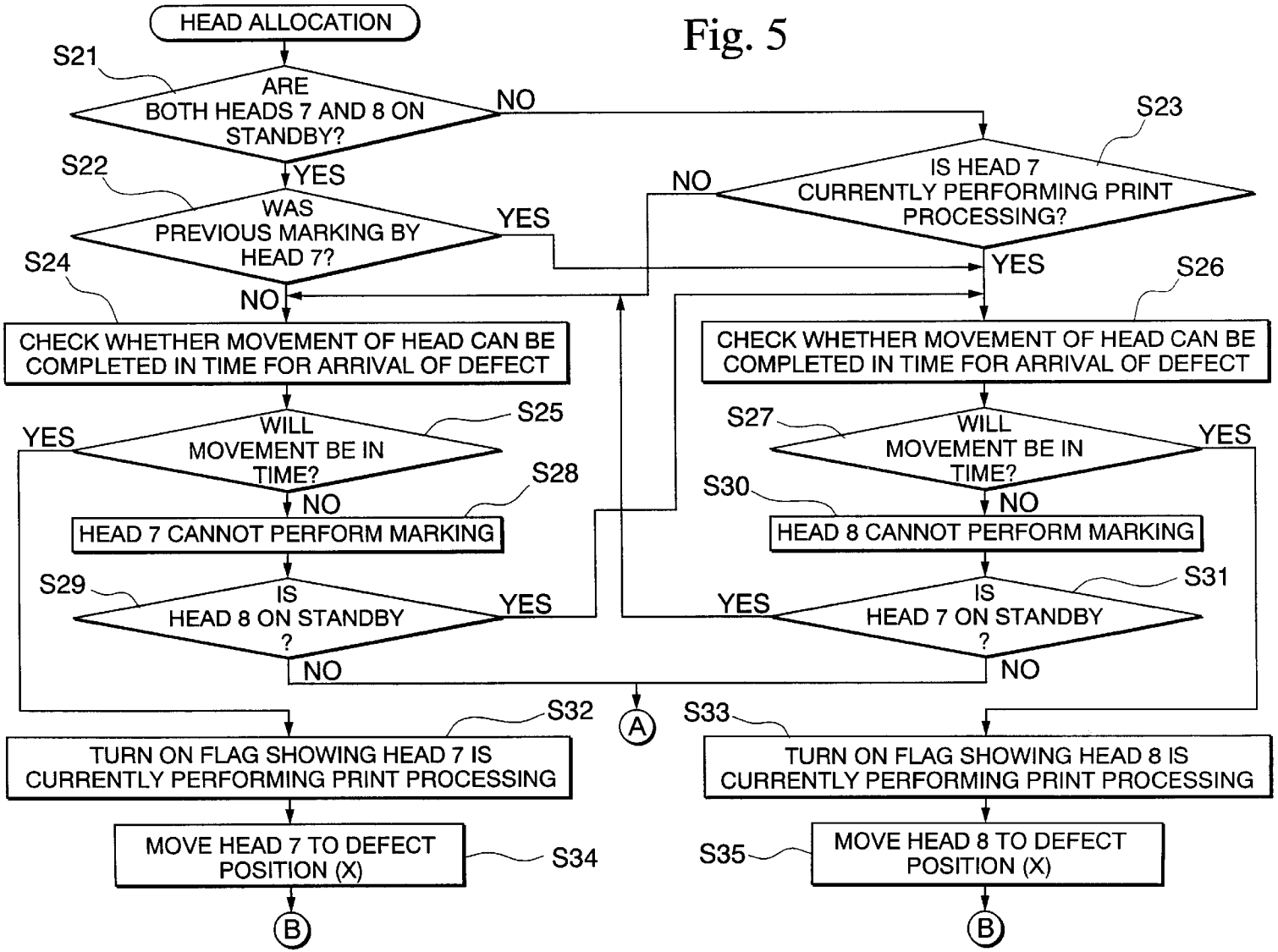
FIG. 5 is a flow chart showing an example of the head allocation processing in the marking system in the present invention.
Figure 6:
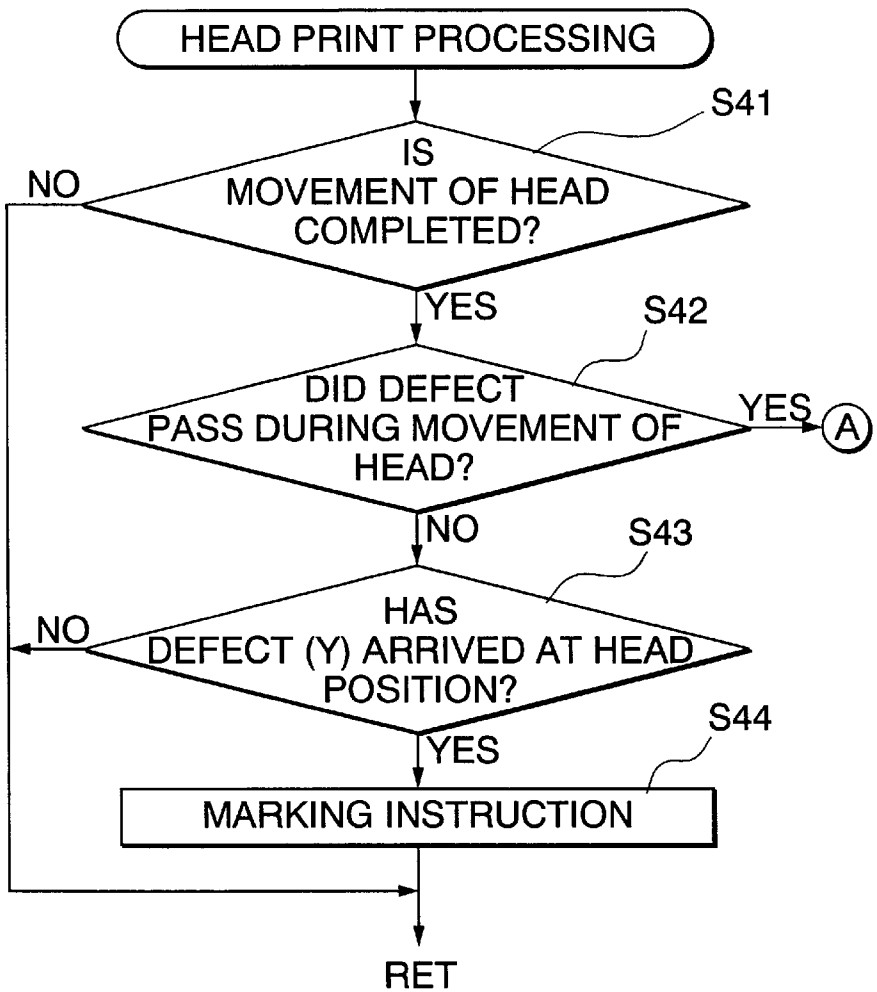
FIG. 6 is a flow chart showing an example of head printing processing in the marking system of the present invention.
Figure 8:
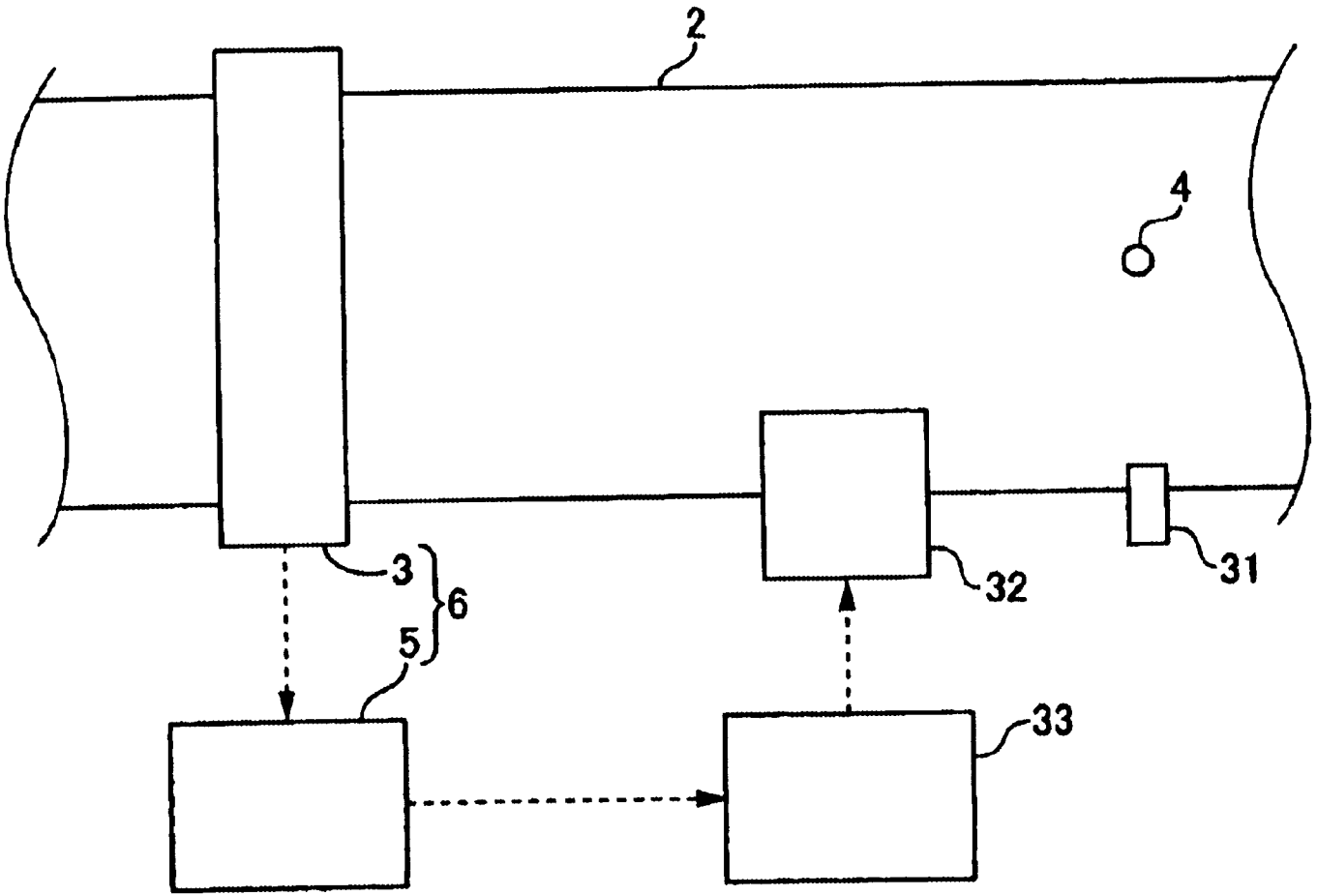
Fig. 8 (Prior Art)
FIG. 8 is a schematic structural diagram showing an example of a conventional marking system.
Figure 9:
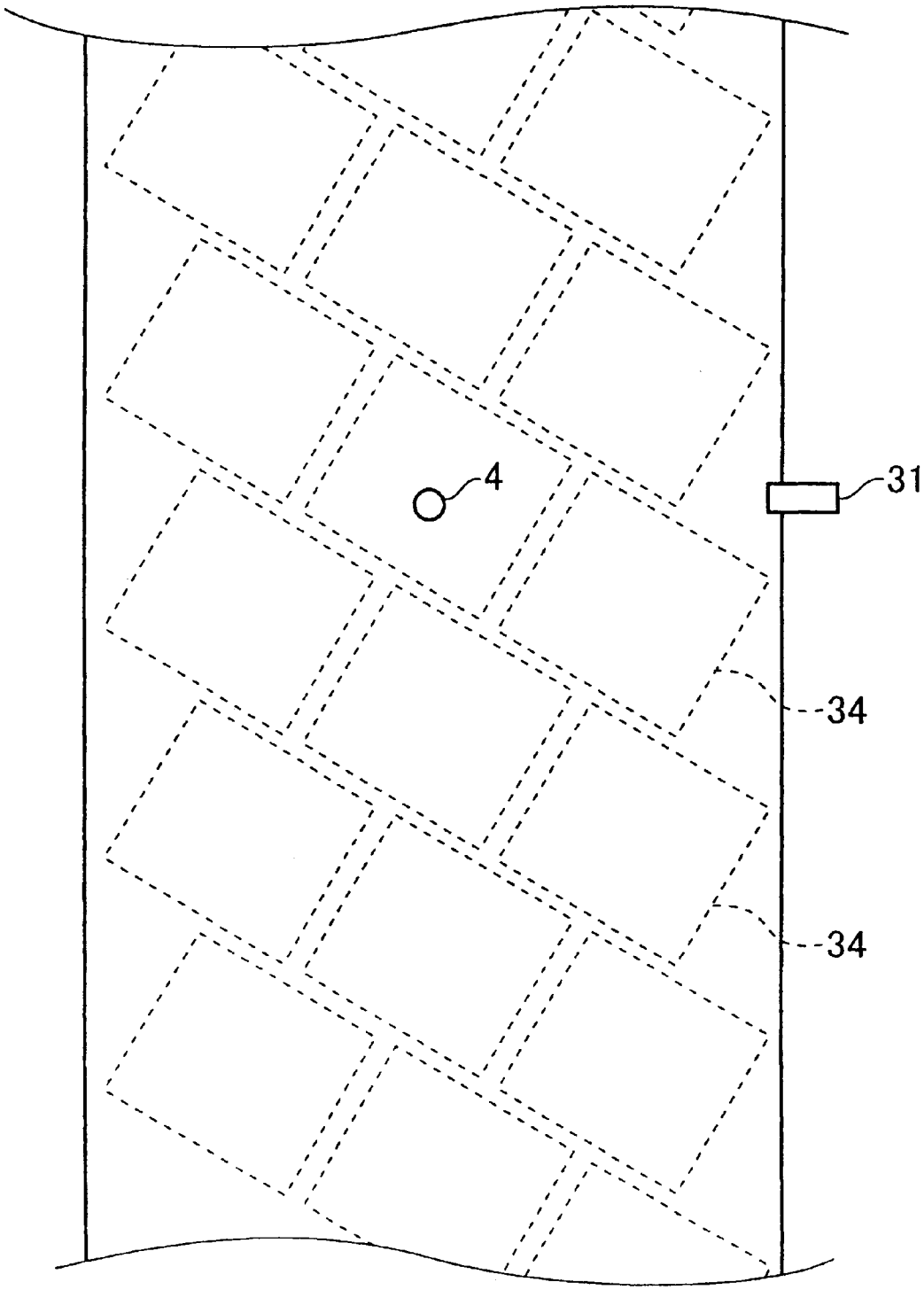
FIG. 9 is a view showing locations at which sheets are punched from a subject material (in the form of a roll) after an examination.

FIGS. 4 to 6 are flow charts showing the flow of marking processing performed in the computer section.

Firstly, whether or not the head 7 is currently performing print processing for an already detected defect is confirmed (step S1). If the head 7 is currently performing print processing, the routine moves to a head print processing subroutine (step S2).

Next, whether or not the head 8 is currently performing print processing for an already detected defect is confirmed (step S3). If the head 8 is currently performing print processing, the routine moves to a head print processing subroutine (step S4).

In the head print processing subroutine, firstly, whether or not the movement of a head to a position X of a defect in the transverse direction acquired by the image processing apparatus 5 has been completed (i.e., whether or not X=X2) is confirmed (step S41). If this movement has not been completed the routine returns to the main routine.

If this movement has been completed, whether or not the defect has already passed under the position of the head during the movement of the head (i.e., whether or not the count value>Y+the count correction value) is confirmed (step S42). If the defect has already passed under the position of the head, the position (X, Y) thereof is saved as a defect that could not be marked (step S11).

Next, whether or not the defect has arrived at the position Y of the head is confirmed. Namely, whether or not the count number of the standard pulses counted by the control board matches the value of a total obtained by adding a count value representing the position Y of the defect 4 in the movement direction to a count correction value that corresponds to the distance between the camera and the head 7 or the head 8 is confirmed (step S43). If the defect has not arrived at the position of the head, (i.e., if the count value<Y+the count correction value), the routine returns to the main routine. If the defect has arrived at the position of the head, (i.e., if the count value=Y+the count correction value), an instruction to mark the defect is sent to the marking apparatus 9 (step S44) and the routine returns to the main routine.

After the head print processing, whether or not a new defect has been detected is confirmed (step S5). If a new defect has not been generated, the marking processing for an already detected defect (steps S1 to S4) is repeated.

If a new defect has been detected, firstly, whether or not both the head 7 and the head 8 are currently performing print processing is confirmed (step S6). If both heads are currently performing print processing, then marking of a new defect cannot be performed. Therefore, the position (X, Y) thereof is saved as a defect that could not be marked (step S11).

Whether or not the head 7 is currently performing print processing is then confirmed (step S7). If the head 7 is not currently performing print processing, the position (X, Y) of the new defect is acquired and the time until the position Y of the defect in the movement direction arrives at the position of the head 7, and the movement time of the head from the position X2 of the head 7 in the transverse direction to the position X of the defect in the transverse direction are calculated (step S8). The routine them moves to the subsequent head allocation processing.

In step S7, if the head 7 is currently performing print processing, whether or not the head 8 is currently performing print processing is then confirmed (step S9). If the head 8 is not currently performing print processing, the position (X, Y) of the defect is acquired and the time until the position Y of the defect in the movement direction arrives at the position of the head 8, and the movement time of the head from the position X2 of the head 8 in the transverse direction to the position X of the defect in the transverse direction are calculated (step S10). The routine then moves to the subsequent head allocation processing.

The head allocation processing is performed in the following manner.

If both of the heads 7 and 8 are currently on standby (step S21) and the previous marking was not performed by the head 7 (step S22), or, alternatively, if both the heads 7 and 8 are not currently on standby (step S21) and the head 7 is not currently printing (step S23), a comparison is made between the time until the position Y of the defect in the movement direction arrives at the position of the head 7 and the movement time of the head from the position X2 of the head 7 in the transverse direction to the position X of the defect in the transverse direction (step S24). If it is then determined that the movement of the head 7 will be in time for the arrival of the defect (step S25), the head 7 is allocated the defect marking processing.

If, however, both of the heads 7 and 8 are currently on standby (step S21) and the previous marking was performed by the head 7 (step S23), or, alternatively, if both the heads 7 and 8 are not currently on standby (step S21) and the head 7 is currently printing (step S23), a comparison is made between the time until the position Y of the defect in the movement direction arrives at the position of the head 8 and the movement time of the head from the position X2 of the head 8 in the transverse direction to the position X of the defect in the transverse direction (step S26). If it is then determined that the movement of the head 8 will be in time for the arrival of the defect (step S27), the head 8 is allocated the defect marking processing.

In step S25, if it is determined that the movement of the head 7 will not be in time for the arrival of the defect (step S28), whether or not the head 8 is currently on standby is confirmed (step S29). If the head 8 is currently on standby, the routine moves to step S26 and whether or not the marking can be performed by the head 8 is confirmed. If it is confirmed in step S29 that the head 8 is not currently on standby, the position (X, Y) of the defect is saved as a defect that could not be marked (step S11).

In step S27, if it is determined that the movement of the head 8 will not be in time for the arrival of the defect (step S30), whether or not the head 7 is currently on standby is confirmed (step S31). If the head 7 is currently on standby, the routine moves to step S24 and whether or not the marking can be performed by the head 7 is confirmed. If it is confirmed in step S31 that the head 7 is not currently on standby, the position (X, Y) of the defect is saved as a defect that could not be marked (step S11).

After the head allocation processing has been performed in this way, a flag indicating the head is currently printing is set to ON for the head 7 or the head 8 allocated in the marking processing (step S32 or S33), and the movement of the head to the position X of the defect in the transverse direction is begun (step S34 or S35). The routine then returns to the start of the main routine of the marking processing and the print processing of the respective heads is performed.

The computer section may be formed by dedicated hardware or, alternatively, the computer section may be formed by memory and a central processing unit (CPU) and the functions of the computer section may be realized by a program for performing the functions of the computer section that is loaded in this memory.

Moreover, an input apparatus, a display apparatus, and the like are connected as peripheral devices to the computer section. Here, the input apparatus is a display touch panel, a switch panel, a keyboard, or the like, and the display apparatus is a CRT or a liquid crystal display unit.

Because this type of marking system 1 is provided with a marking apparatus 9 having heads 7 and 8 that are capable of moving in the transverse direction over the subject material 2, and with a control apparatus 10 that transmits a position X of a defect 4 in the transverse direction that is acquired by the image processing apparatus 5 of the detector 6 to the head travel sections 11 and 12 of the marking apparatus 9, it is possible to move the head 7 and the head 8 to the position X of the defect 4 in the transverse direction. In addition, because this type of marking system 1 is provided with the control apparatus 10 that sends a marking instruction to the marking apparatus 9 when the position of the defect matches the position of the head 7 or the head 8 of the marking apparatus 9, it is possible to perform the marking at the time when the defect 4 arrives at the head 7 or the head 8 of the marking apparatus 9.

In the marking system 1 in which the heads 7 and 8 are able to be moved to the position X of the defect 4 in the transverse direction, and in which marking can be done at the time when the defect 4 arrives at the head 7 or the head 8 of the marking apparatus 9, it is possible to make a mark either directly on or adjacent to the defect 4.

Moreover, in the marking system 1, because the marking apparatus 9 has two heads 7 and 8, and because the control apparatus 10 is able to allocate the head 7 or 8 for each defect, even when a plurality of defects are detected in a short period of time, it is possible for marking failures to be kept to the absolute minimum. Furthermore, in this head allocation, because the head 8 is allocated for a particular marking when the head 7 was used for the previous marking, it is possible to ensure that the frequency of use of each of the heads 7 and 8 is kept approximately equal and the ink of one head only does not get used up.

Moreover, because the marking apparatus 9 is provided with the ink outlets 21 and 22 that form outlets for the ink that is discharged from the discharge apertures of the heads 7 and 8, and with the air outlets 23 for expelling air from inside the box 13, any dust that is generated by the movement of the heads 7 and 8 can be prevented from falling onto the subject material 2.

In addition, because the marking apparatus 9 is provided with two heads 7 and 8, even when a plurality of defects are detected in a short period of time, it is possible for marking failures to be kept to the absolute minimum.

Note that the number of heads in the marking apparatus 9 is two, however, the marking system and marking apparatus of the present invention are not limited to the examples shown in the drawings, and it is also possible for the marking system and marking apparatus to have one head or to have three or more heads. However, when one head is used, then a plurality of defects detected in a short period of time cannot be dealt with and the concern exists that marking failures will result. In contrast, if the number of heads is too great, the head allocation processing and the head control become complicated and the cost of the apparatus itself increases. Therefore, it is preferable that the number of heads in the marking system and marking apparatus of the present invention is two or three.

Any head can be used for the heads in the marking apparatus and marking system of the present invention provided that it is capable of marking an optional location in the transverse direction of the subject material. The head is not restricted to one that can move in the transverse direction, as in the example in the drawings and, for example, a structure may also be employed in which a plurality of heads are lined up in a row along the transverse direction of the subject material.

The color of the ink discharged from the heads may be selected as appropriate to the color of the subject material and is not particularly limited.

The heads of the marking apparatus in the marking system of the present invention are not restricted to the inkjet type heads shown in the drawings. For example, water based pens, oil based pens, stamps and the like may also be used.

In the marking system and marking apparatus of the present invention, when the heads are inkjet type heads, an ink cartridge can be connected to the head. By connecting an ink cartridge to the head, no hose is needed to connect the head to the inkjet printer body, enabling the space required to be reduced and the movement of the head to be speeded up. In addition, problems connected with blockages of the hose can be avoided.

A marking method using the marking system of the present invention will now be described.

Light that is irradiated from a light source onto the subject material and is transmitted through or reflected by the subject material 2 is captured by the camera 3 of the detector 6. The light captured by the camera 3 is output to the image processing apparatus 5 as image signals.

The image signals undergo image processing in the image processing apparatus 5 of the detector 6. If a defect 4 that meets preset conditions (e.g., size, density, etc.) is detected in the processed image signals, data on the size, position (i.e., the position X in the transverse direction and the position Y in the movement direction thereof), type, and the like of the detected defect 4 is acquired.

The acquired position of the defect 4 is sent to the computer section of the control apparatus 10. In the computer section processing (the above described head allocation processing) is performed to decide which head is to perform the marking processing for the detected defect 4, and a head is allocated for the defect 4. A flag is set for the allocated head showing that the head is currently performing print processing. Here, the head 7 will be taken as the one allocated.

After the head allocation processing has ended, from the position of the defect 4 sent to the computer section, the position X in the transverse direction of the subject material 2 is transmitted to the head travel section 11 of the marking apparatus 9, and the movement of the head 7 to the position X is begun.

Figure 7:
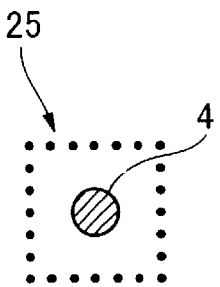
FIG. 7 is a view showing an example of marking.

While the flag showing that the head 7 is currently performing print processing is set to ON, whether or not the position Y of the defect 4 has arrived at the position of the head 7 is constantly monitored in the computer section. When the defect 4 arrives at the position of the head 7 (i.e., when the position X of the defect 4 in the transverse direction matches the position X2 of the head 7 or the head 8 in the transverse direction, and the count value of the standard pulses matches a value equal to the sum of the count value representing the position Y of the defect 4 in the movement direction and the count correction value), a marking instruction is sent to the inkjet printer body 16 of the marking apparatus 9. Ink is then discharged from the head 7 and a mark 25 formed, for example, by broken lines in a 7 mm by 7 mm rectangular pattern, such as is shown in FIG. 7, is made around the defect 4.

The flag showing the head 7 is currently performing print processing is set to OFF when the marking has ended. The head 7 is then placed on standby until another defect is detected and the marking processing is again allocated to the head 7.

In this type of marking method, because a marking apparatus 9 is used that has heads 7 and 8 that are capable of moving in the transverse direction over the subject material 2, and because an acquired position X of a defect 4 in the transverse direction is transmitted to the head travel sections 11 and 12 of the marking apparatus 9, it is possible to move the head 7 and the head 8 to the position X of the defect 4 in the transverse direction. In addition, in this type of marking method, because a marking instruction is sent to the marking apparatus 9 when the position of the defect matches the position of the head 7 or the head 8 of the marking apparatus 9, it is possible to perform the marking at the time when the defect 4 arrives at the head 7 or the head 8 of the marking apparatus 9.

Moreover, in this marking method in which the head 7 or the head 8 is moved to the position X of the defect 4 in the transverse direction, and in which marking can be done at the time when the defect 4 arrives at the head 7 or the head 8 of the marking apparatus 9, it is possible to make a mark either directly on or adjacent to the defect 4.

Moreover, in this marking method, because the head 7 or 8 can be allocated for each defect in cases when the marking apparatus 9 has the two heads 7 and 8, even when a plurality of defects are detected in a short period of time, it is possible for marking failures to be kept to the absolute minimum.

What is claimed is:

1. A marking method in which a mark is made on a marking target on a subject material by a marking apparatus having a head that is capable of marking an optional position in a transverse direction of the subject material, comprising:

a step in which a marking target on a belt shaped subject material moving in a fixed direction at a fixed speed is detected at a position upstream from the marking apparatus, and the position of the marking target on the subject material is acquired;

a step in which the acquired position in the transverse direction of the marking target is transmitted to the marking apparatus; and a step in which a marking instruction is sent to the marking apparatus when the position of the marking target matches the position of the head of the marking apparatus.

2. The marking method according to claim 1, wherein, when the marking apparatus has a plurality of heads, the marking method comprises a further step in which a head is allocated for each marking target.

3. A marking system, comprising:

a detector that detects a marking target on a belt shaped subject material moving in a fixed direction at a fixed speed and acquires the position of the marking target on the subject material;

a marking apparatus having a head that is located downstream from the detector and that is capable of marking an optional position in a transverse direction of the subject material; and a control apparatus that transmits the position of the marking target in the transverse direction that was acquired by the detector to the marking apparatus, and sends a marking instruction to the marking apparatus when the position of the marking target matches the position of the head of the marking apparatus.

4. The marking system according to claim 3, wherein the marking apparatus is provided with a plurality of heads, and the control apparatus allocates a head for each marking target.

* * * * *